US005931231A

United States Patent [19]

Mock

[11] Patent Number: 5,931,231

[45] Date of Patent: Aug. 3, 1999

[54] BLAST HOLE DRILL PIPE GRIPPING MECHANISM

[75] Inventor: Erwin Mock, Oak Creek, Wis.

[73] Assignee: Bucyrus International, Inc., South Milwaukee, Wis.

[21] Appl. No.: 08/879,930

[22] Filed: Jun. 17, 1997

Related U.S. Application Data

[60] Provisional application No. 60/020,662, Jun. 27, 1996, and provisional application No. 60/020,692, Jun. 27, 1996.

[51] Int. Cl.[6] ..... E21B 19/16

[52] U.S. Cl. ..... 166/377; 166/77.51; 166/85.1; 166/77.53; 173/164

[58] Field of Search ..... 166/377, 378, 166/77.51, 85.1, 78.1, 77.53; 175/85, 122, 162; 173/164

[56] References Cited

U.S. PATENT DOCUMENTS

| | | | |
|---|---|---|---|
| 2,871,743 | 2/1959 | Kelley | 81/53 |
| 3,177,944 | 4/1965 | Knights | 166/77.5 |
| 3,194,313 | 7/1965 | Fanshawe | 166/77.5 |
| 3,316,783 | 5/1967 | Wilson | 81/54 |
| 3,500,708 | 3/1970 | Wilson | 81/57.34 |
| 3,506,075 | 4/1970 | Attebo | 175/52 |
| 3,702,640 | 11/1972 | Cintract et al. | 175/85 |
| 3,803,953 | 4/1974 | Geczy et al. | 166/77.51 |
| 4,082,017 | 4/1978 | Eckel | 81/57 |
| 4,660,634 | 4/1987 | Johnson | 166/77.51 |
| 4,843,945 | 7/1989 | Dinsdale | 175/85 X |
| 4,867,236 | 9/1989 | Haney et al. | 166/77.51 |
| 5,653,297 | 8/1997 | Whisenhunt | 175/52 |

OTHER PUBLICATIONS

Applicant's Exhibit A; Bucyrus–Erie Company parts lists pp. 12–4 (1 through 4), 12–5 (and 2), 12–6 (1 and 2), 12–7 (1 and 2), and operating instructions 45 591 (two pages), dated between Sep. 1983 and Jun. 1989.

Applicant's Exhibit B; Bucyrus–Erie Company parts lists (plate VM 1468, two pages) and operating instructions pp. 4–15 through 4–27, dated Feb. 1995.

*Primary Examiner*—Roger Schoeppel

*Attorney, Agent, or Firm*—Quarles & Brady

[57] ABSTRACT

A mechanism for loosening the threaded joint between members of a blast hole drill string includes a wrench to hold one of the members while the other member is gripped between one arm and a jaw pivotally mounted on the arm. A hydraulic cylinder advances one end of the arm to engage the member and another cylinder pivots the jaw to engage the member. The one end of the arm is then further advanced while the other end of the arm is retracted by a cylinder to apply a moment. The wrench has a pair of wrench arms that are pivotally attached at their rear to a support. Pawls are mounted on the wrench arms to engage slots in a drill pipe. A hydraulic cylinder is mounted between the wrench arms to open and close the arms. One end of the cylinder is fixed to one wrench arm while the other end is connected to the second arm by a spring mechanism.

8 Claims, 8 Drawing Sheets

106
74
91
90
92
83
63
105
88
80
87
72
82
81
85
80
73
71
60
66
70
106
86
105
64

100
17
102
101
100

BLAST HOLE DRILL PIPE GRIPPING MECHANISM

This application claims the benefit of U.S. provisional patent applications Ser. No. 60/020,662 filed Jun. 27, 1996 and No. 60/020,692 filed Jun. 27, 1996.

BACKGROUND OF THE INVENTION

This invention relates to mechanisms for manipulating sections of pipe to form drill strings, and particularly to a mechanism for holding a section of the drill pipe and for loosening the threaded connection between sections of the drill pipe.

Blast hole drills and other similar drilling rigs use drill strings that are made up of drill pipes that are threaded end to end. In adding to and removing pipe from the drill string, it is necessary to hold sections of pipe against rotation. A tool wrench is typically employed for that purpose.

One form of tool wrench engages flats on a drill pipe much like that of an open-end wrench engaging a bolt or nut. To engage this form of wrench, the drill operator is required to rotate the drill pipe until the flats on the drill pipe are aligned with the wrench. At this point, the wrench is slid over the flats on the drill pipe. The operator then turns the drill pipe and the wrench until the wrench hits stops provided on the mast drill deck.

In another form of tool wrench, slots are provided in the drill pipe that are engaged by pawls on the ends of wrench arms. The slots allow 40° of pipe rotation in either a clockwise or counterclockwise direction. A further form of tool wrench uses individually spring-loaded pawls.

In adding or removing pipe from the drill string, it is also necessary to provide a mechanical assist to loosen the threaded connection between sections of pipe. This is typically accomplished using a casing tong that grips and rotates one section of the pipe while the adjacent section is held against rotation by the tool wrench.

A common form of power operated drill pipe tong includes hydraulic cylinder assemblies for moving jaws into engagement with a pipe joint. Cylinder assemblies are also provided to afford a torquing action to make up or break apart a drill string. In many instances problems arise as sufficient torque cannot be applied because the force applied by the hydraulic cylinder on a jaw of the casing tong is in a single direction.

I provide a casing tong which can be extended from and retracted to a stored position and also affect a unique push-pull action on the drill pipe joint.

SUMMARY OF THE INVENTION

In accordance with the invention, a mechanism for loosening a threaded joint between first and second members of a drill string includes a wrench engageable with the second member to restrain the same. An arm has first and second ends and a grip. A jaw is mounted for movement on the arm and has a grip that can oppose the grip on the arm. Means are provided for advancing the first end of the arm to engage its grip with the first member, for moving the jaw to engage its grip with the first member, and for further advancing the first end of the arm while retracting the second end of the arm to apply a moment to the first member.

In the preferred embodiment, a casing tong is connected to a drilling apparatus and includes a tong arm and a tong jaw pivotally mounted on the tong arm. The tong arm is slidably mounted over a guide member and is extended and retracted at one end by a hydraulic cylinder. A second hydraulic cylinder is connected at an opposing end of the tong arm to effect a second extension and retraction of the tong arm. A third cylinder assembly provides a pivoting of the jaw on the arm. The tong jaw includes a pivotal die member to grip the drill pipe joint. The tong arm also includes dies to grip the pipe joint in an opposing direction from the tong jaw. The automated casing tong is connected to a drill mast by a tong support.

The invention has the advantage that it provides a storage position as well as an operational position for the casing tong. At the same time it provides a push/pull effect on a drill pipe joint for loosening purposes. The casing tong is easily automated by connection with suitable sequencing valves. It can be readily connected to a mast as original equipment or retrofitted. The casing tong can be manufactured from available components.

A control is provided for the hydraulic cylinders to operate the same in a sequence wherein the first hydraulic cylinder is extended from a rest position to engage the grip of the arm with the pipe joint, the third cylinder is extended from a rest position to pivot the jaw to engage its grip with the pipe joint, the first cylinder is further extended while the second cylinder is retracted from a rest position to rotate the pipe joint, and the cylinders are thereafter returned to their respective rest positions.

Further in accordance with the invention, a tool wrench has a pair of wrench arms that are pivotally attached at their rear to a support. The axes of the pivots for the arms are generally parallel with the axis of the drill string. The opposite ends of the arms mount wedge-shaped pawls. The pawls are adapted to seat in wedge-shaped slots formed in the perimeter of the drill pipe. A hydraulic cylinder extends between the arms to open and close the arms. One end of the hydraulic cylinder is fixed to one arm while the other end is connected to the second arm by means of a spring mechanism.

The hydraulic cylinder opens and closes the wrench arms. Upon closing, if the slots in the drill pipe are not in alignment with the pawls on the wrench arms, the spring mechanism will be compressed. As the drill pipe is subsequently rotated, the pawls will snap into place in the slots under the force of the spring mechanism when alignment between the pawls and the slots is achieved. In an opposite direction of rotation of the drill pipe, the pawls will ride out of the slots thereby forcing the wrench arms open. The tool wrench thereby allows 180° of rotation of the pipe before engagement and a ratcheting action with pipe rotation in the opposite direction.

Preferably, the tool wrench support is pivotally mounted to the mast deck so that the entire tool wrench can pivot if the drill string is accidentally hoisted while the wrench arms are engaged with a drill pipe.

The invention also resides in a method of loosening the threaded joint between first and second members that includes the steps of grasping the second member to restrain the same, advancing one end of an arm having a grip into contact with one side of the first member, advancing a jaw having a grip into contact with another side of the first member to clamp the first member between the grips, further advancing the one end of the arm while retracting an opposite end of the arm to rotate the first member, and releasing the contact of the grips with the first member.

The foregoing and other objects and advantages of the invention will appear in the following description of a preferred embodiment. In the description, reference is made to the accompanying drawings.

BRIEF DESCRIPTION OF THE PREFERRED EMBODIMENT

Figure 1:
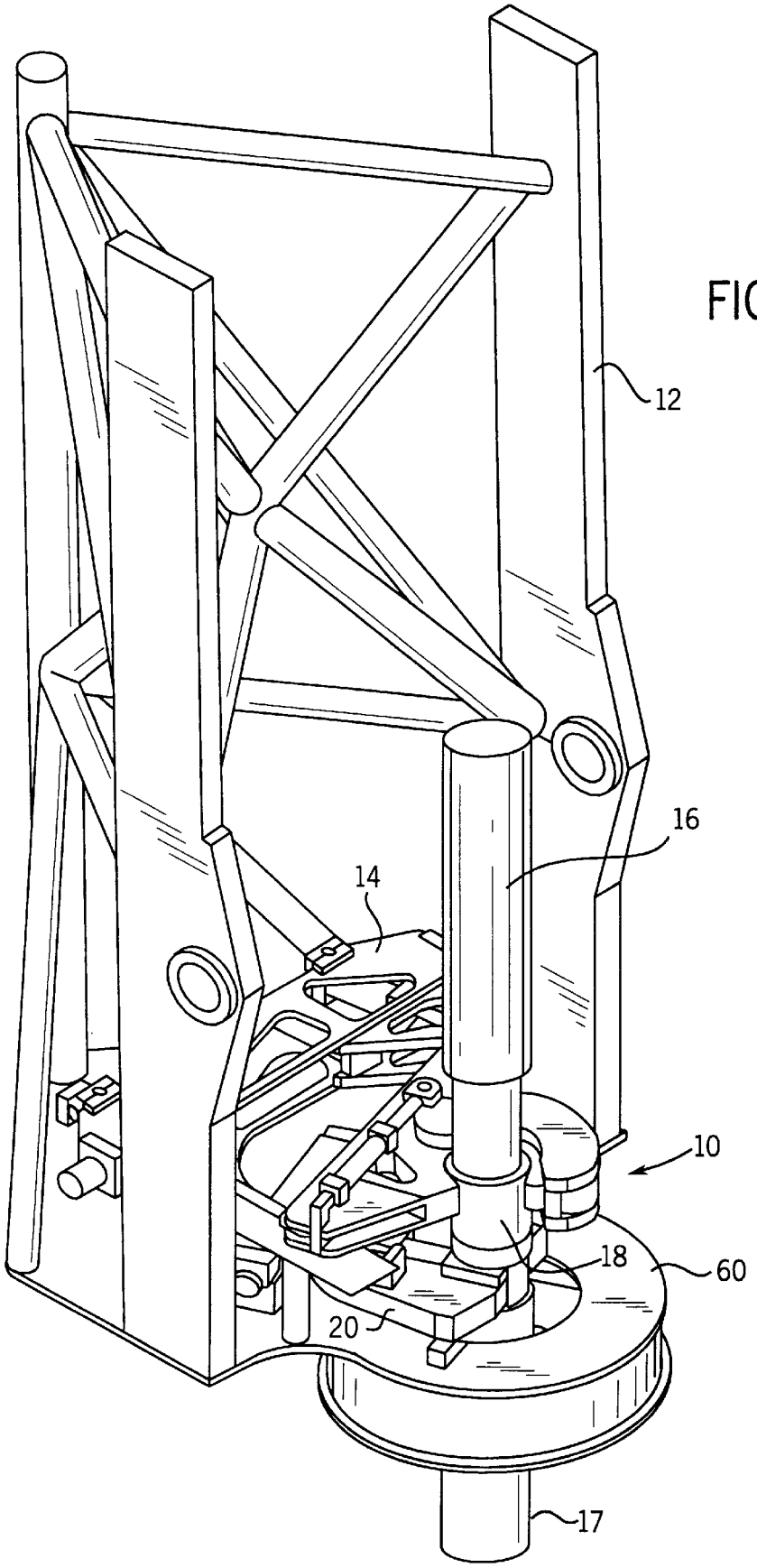
FIG. 1 is a partial view in perspective of a drill mast with the tool wrench and casing tong in place.
Figure 5:
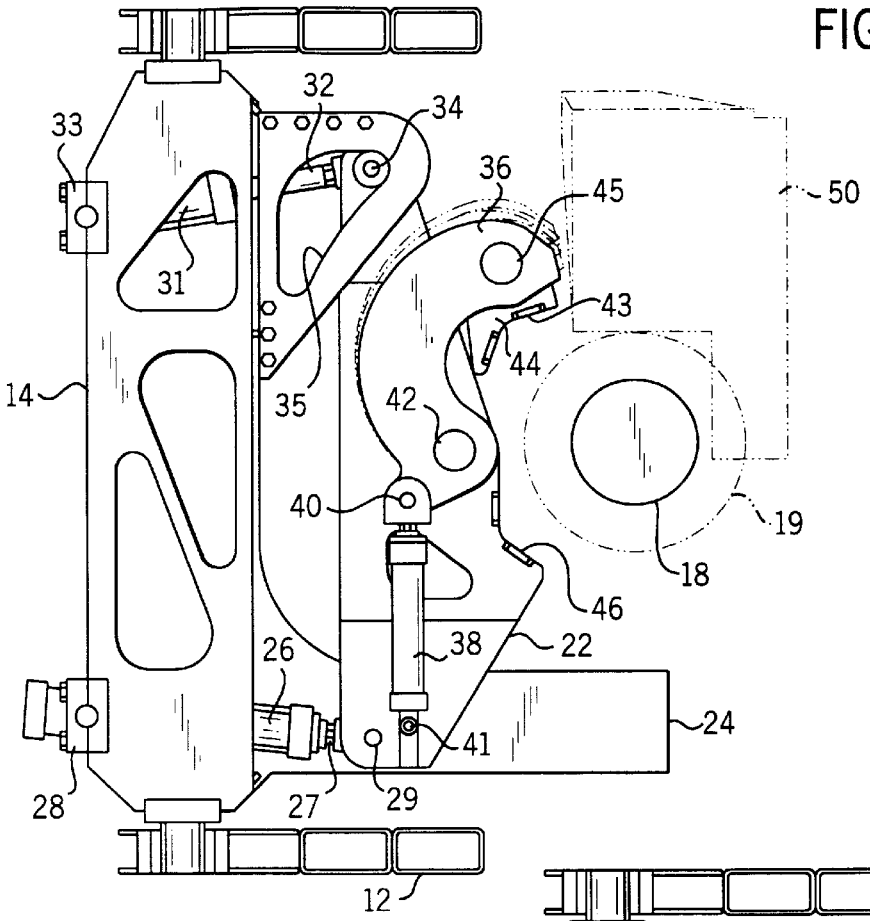
FIGS. 5–11 are top plan views showing the casing tong in various positions with respect to a drill pipe joint.

Referring to FIGS. 1 and 5, the automated casing tong 10 generally is shown in conjunction with a mast 12 which is the subject of a commonly owned provisional patent application Ser. No. 60/020,856 of James P. Piper, Carl D. Gilmore, Kenneth W. Hammel, and Frank R. Szpek, Jr. for "Tubular Drill Mast". The casing tong 10 is attached to the mast 12 by a tong support 14. In a typical manner, two sections of drill pipe 16 and 17 are connected by a drill pipe joint 18 with the lower drill pipe 17 held by a tool wrench 20.

Referring specifically to FIG. 5, the casing tong includes a tong arm 22 which is slidably supported by the support 24. A piston rod 27 of a first hydraulic cylinder 26 is pivotally connected to one end of the arm 22 such as at pivot 29. The opposing end of the arm 22 is also connected to a second hydraulic cylinder 31 such as by the rod 32 and the pivot point 34. Both cylinders 26 and 31 are connected to the tong support 14 such as by the mountings 28 and 33, respectively.

A jaw 36 is pivotally connected to the arm 22 at a pivot point 42. The jaw 36 is connected to a third hydraulic cylinder 38 by means of a pivot 40 with the opposite end of the cylinder 38 mounted on the tong arm 22 by the connection 41.

Also pivotally connected to the jaw link 36 is a grip 44 with die pair portions 43 such as through the pivot 45. Another pair of dies 46 forming a grip is mounted in a stationary manner on the tong arm 22. These dies 43 and 46 assist in gripping the pipe 16. The numeral 50 indicates a customary pipe handling arm, and numeral 19 designates a deck bushing which can clear the casing tong 10 when in the stored position shown in FIG. 5.

Figure 12:
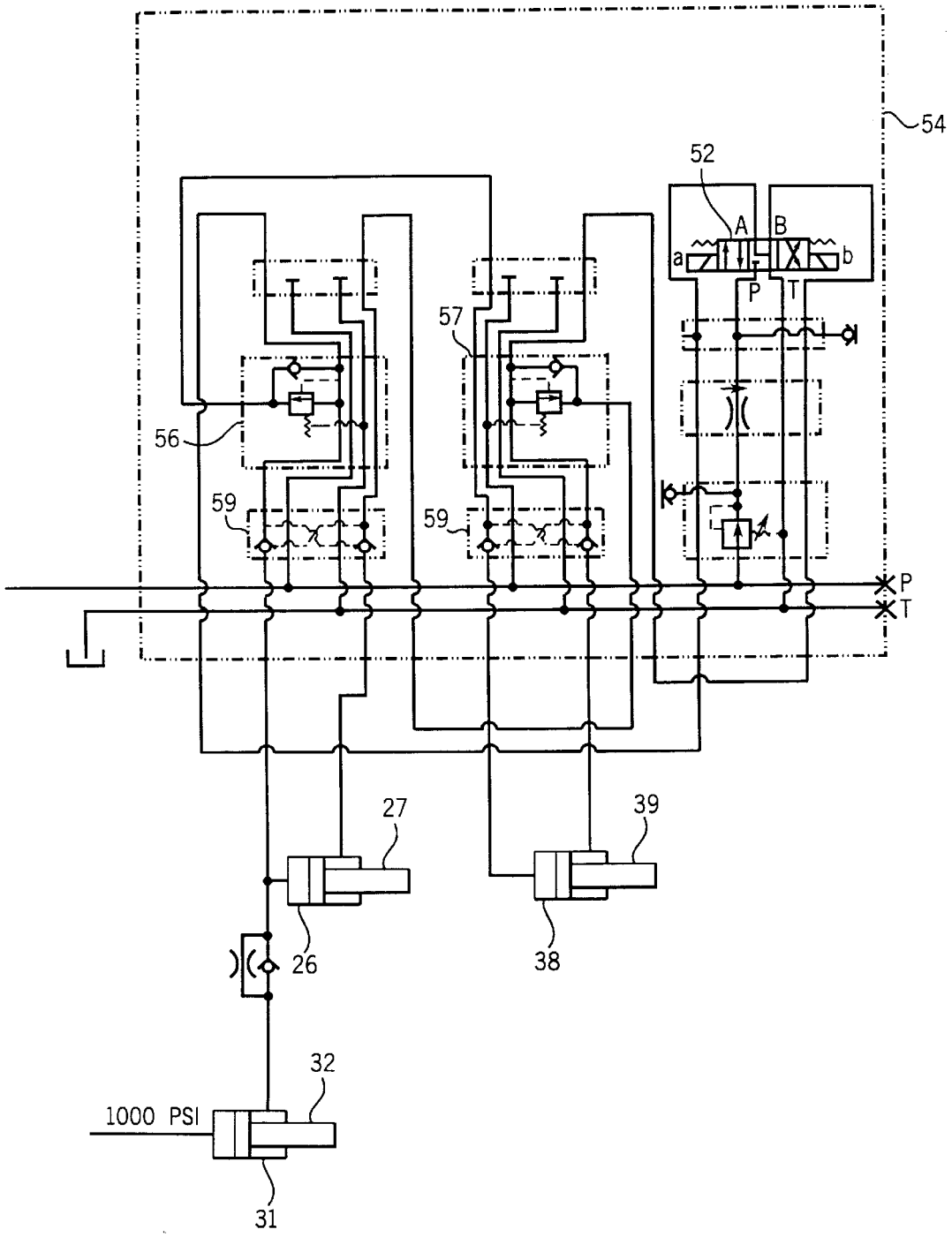
FIG. 12 is a hydraulic schematic view of a sequencing control mechanism for the casing tong.

A better understanding of the casing tong 10 will be had in conjunction with its operation and particularly with the sequencing control mechanism generally 54 shown in FIG. 12.

In the stored position shown in FIG. 5, the casing tong solenoids a and b as designated in FIG. 12 are in the neutral position. No oil can flow from cylinders 26, 31 and 38 because of pilot check valves 59.

Figure 6:
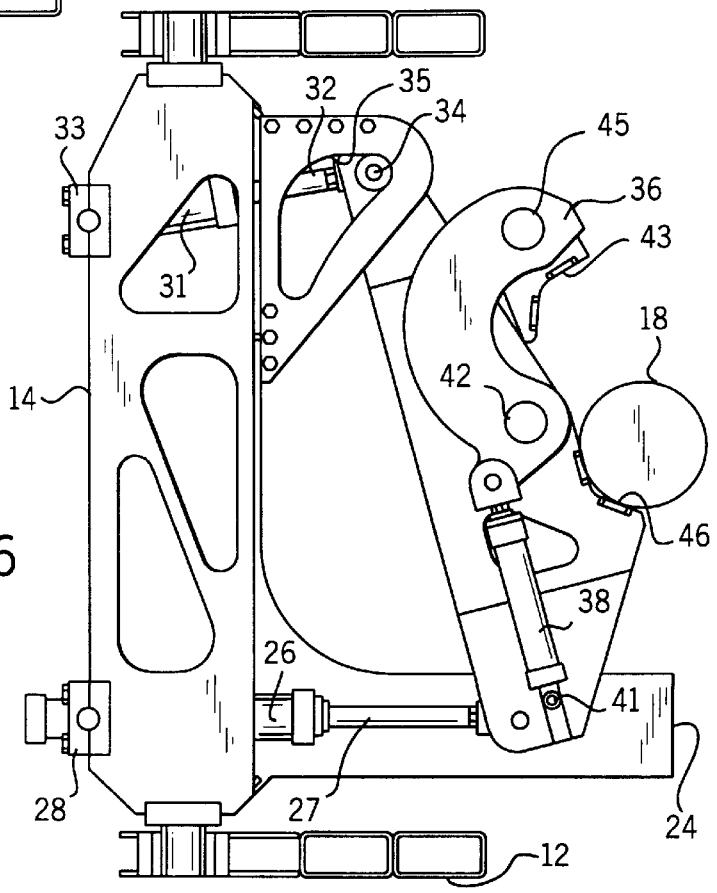

To move the casing tong arm 22 from the stored position into contact with the drill pipe 16, solenoid "a" of spool valve 52 is energized. Hydraulic pressure of approximately 100 psi is then applied to the base end of cylinder 26 to extend the casing tong arm 22 into contact with the drill pipe 16. This is illustrated in FIG. 6. The pressure that is applied to the base end of cylinder 26 is also applied to the rod end of cylinder 31. As a constant hydraulic pressure of 1000 psi is applied to the base end of cylinder 31, force from cylinder 31 holds the pivot point 34 of the second end of the tong arm 22 in the end of a slot 35. Cylinder 31 will not retract at this time.

Figure 7:
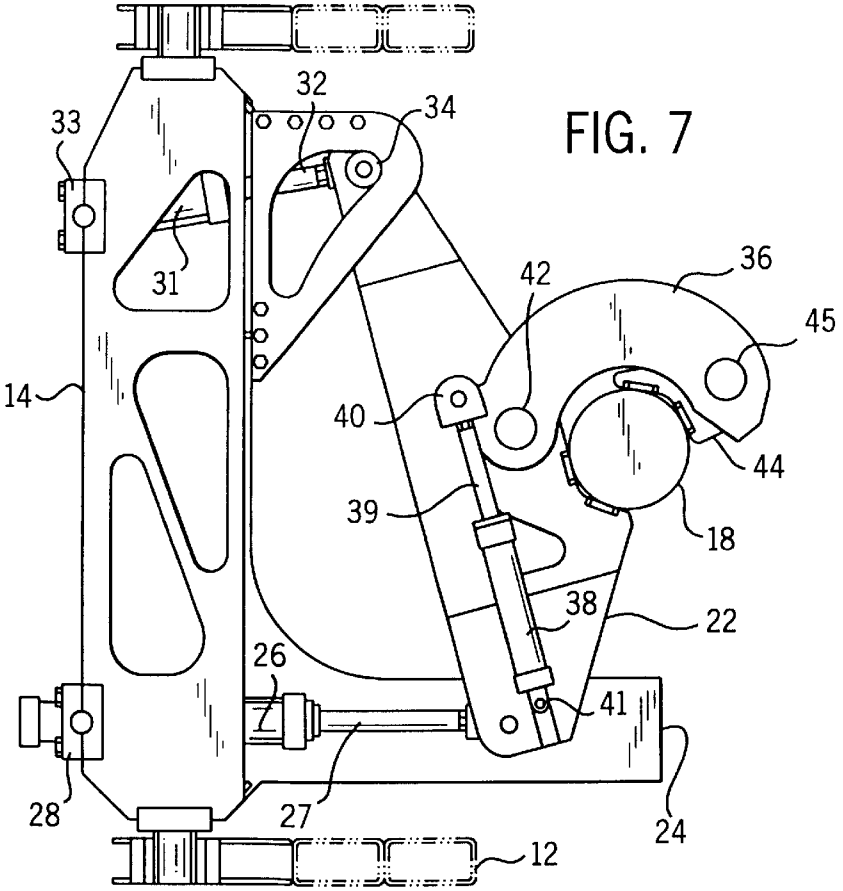

When the tong arm 22 contacts the drill pipe 16, hydraulic pressure to the base end of cylinder 26 and to the rod end of cylinder 31 increases to 500 psi. Hydraulic oil then flows through sequence valve 56 into the base end of cylinder 38 to close the tong jaw 44 to grip the drill pipe 16. This is illustrated in FIG. 7.

Figure 8:
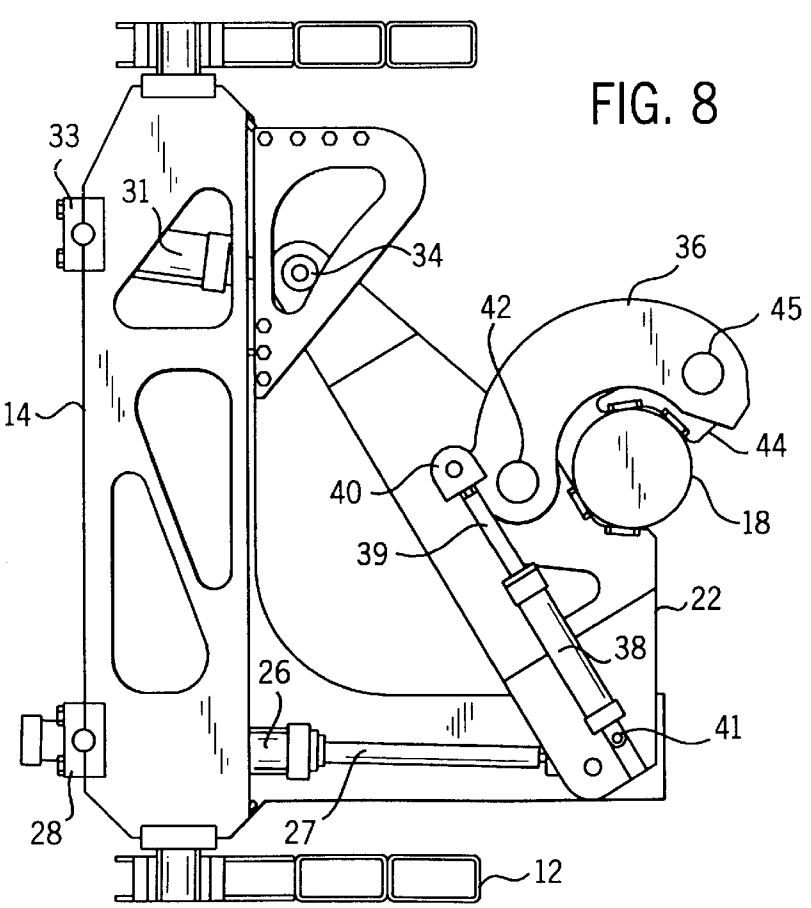

After the drill pipe 16 is gripped, pressure increases equally at the base end of cylinder 26, rod end of cylinder 31, and the base end of cylinder 38 until the drill pipe joint 18 loosens. Cylinder 26 pushes and cylinder 31 pulls the tong arm 22 in a counter-clockwise direction to loosen the drill pipe joint 18. This is shown in FIG. 8. Calculations show that the maximum drill pipe reaction force for the automatic casing tong 10 is less than the maximum drill pipe reaction force for a manual casing tong. This means the automatic casing tong 10 will not bend the drill pipe 16 as much as a manual casing tong.

To retract the tong arm 22 to the stored or rest position, solenoid "b" of spool valve 52 is energized. Pressure is first applied to the rod end of cylinder 38 while cylinders 26 and 31 are kept from moving by pilot check valves 59. The tong jaw 44 may be locked to the drill pipe 16 because of internal forces. If the tong jaw 44 is locked, hydraulic pressure applied to the rod end of cylinder 38 raises to 500 psi. Hydraulic oil then flows through sequence valve 57 to the rod end of cylinder 26. Pilot check valves 59 connected to the base end of cylinder 26 and the rod end of cylinder 31 open to allow movement in the cylinders. The resulting movement of the tong arm 22 unlocks the tong jaw 44. Pressure to the rod end of cylinder 38 drops below 500 psi and pilot check valves stop movement in cylinders 26 and 31. Normal retract then begins.

Figure 10:
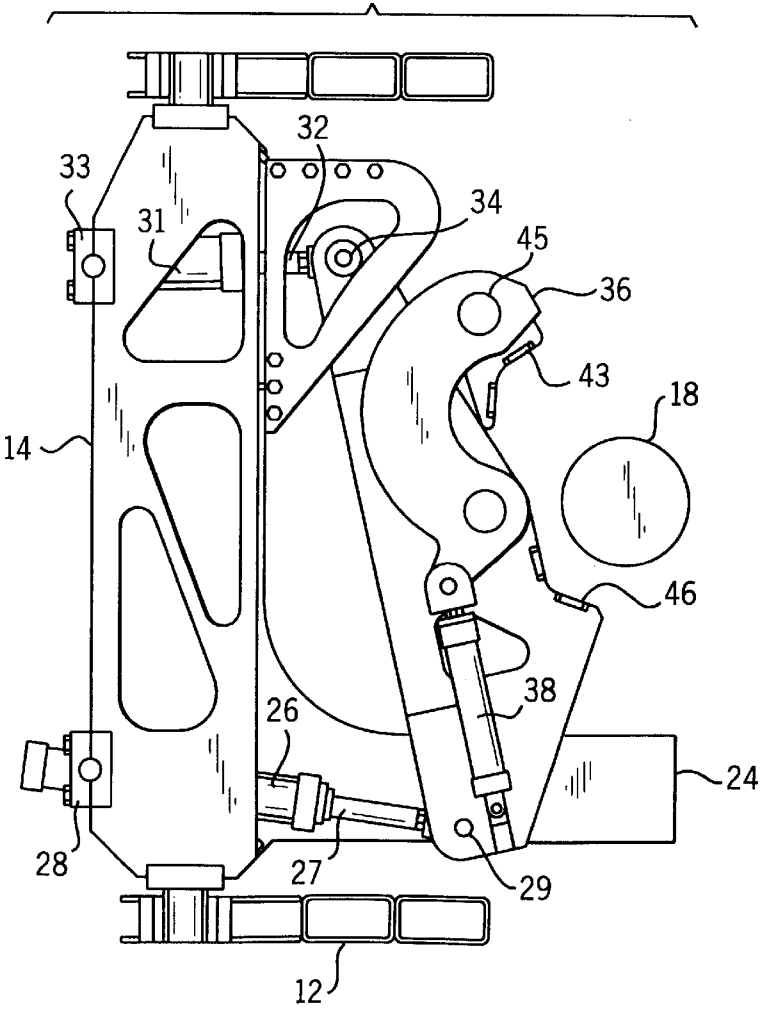
Figure 9:
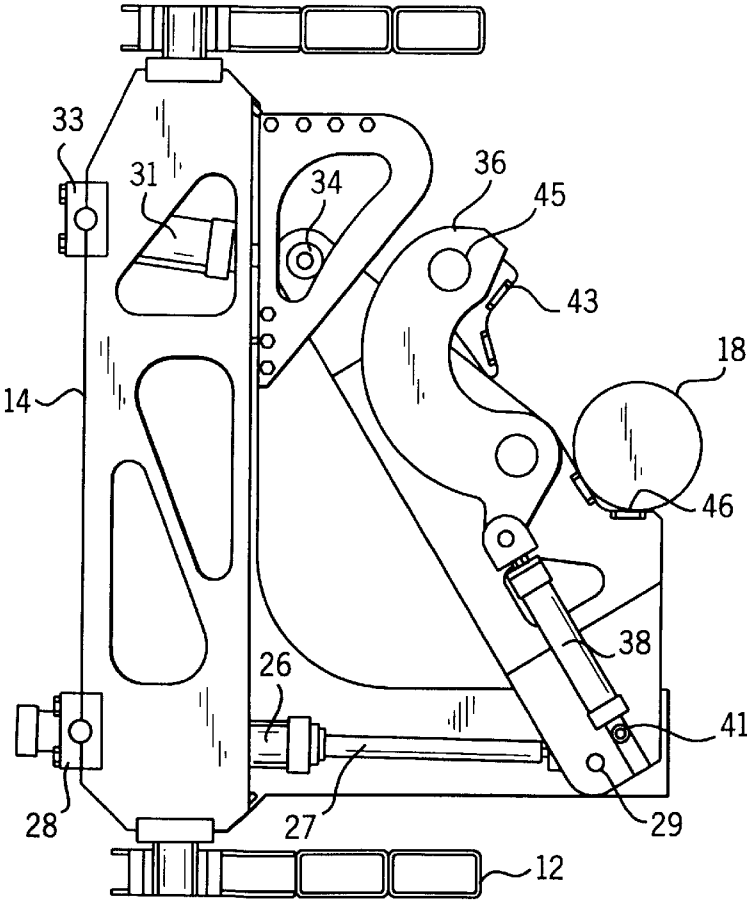

In normal retract, cylinder 38 retracts completely first. This is shown in FIG. 9. Pressure on the rod end of cylinder 38 then increases to 500 psi. Hydraulic oil then flows through sequence valve 57 to the rod end of cylinder 26. Pilot check valves open to allow retracting of cylinder 26 and extending of cylinder 31. This is illustrated in FIG. 10. A choke attached to the rod end of cylinder 31 controls flow from cylinder 31 to ensure that cylinder 26 retracts faster than cylinder 31 extends. This action causes the tong arm 22 to retract away from the drill pipe joint 18 without turning about the drill pipe joint. This feature reduces sliding between the tong dies 43 and 46 and the drill pipe 16 resulting in longer tong die life.

The P and T designations in FIG. 12 are for Pressure and Tank with the A and B designations indicating the ports of the spool valve 52.

Figure 11:
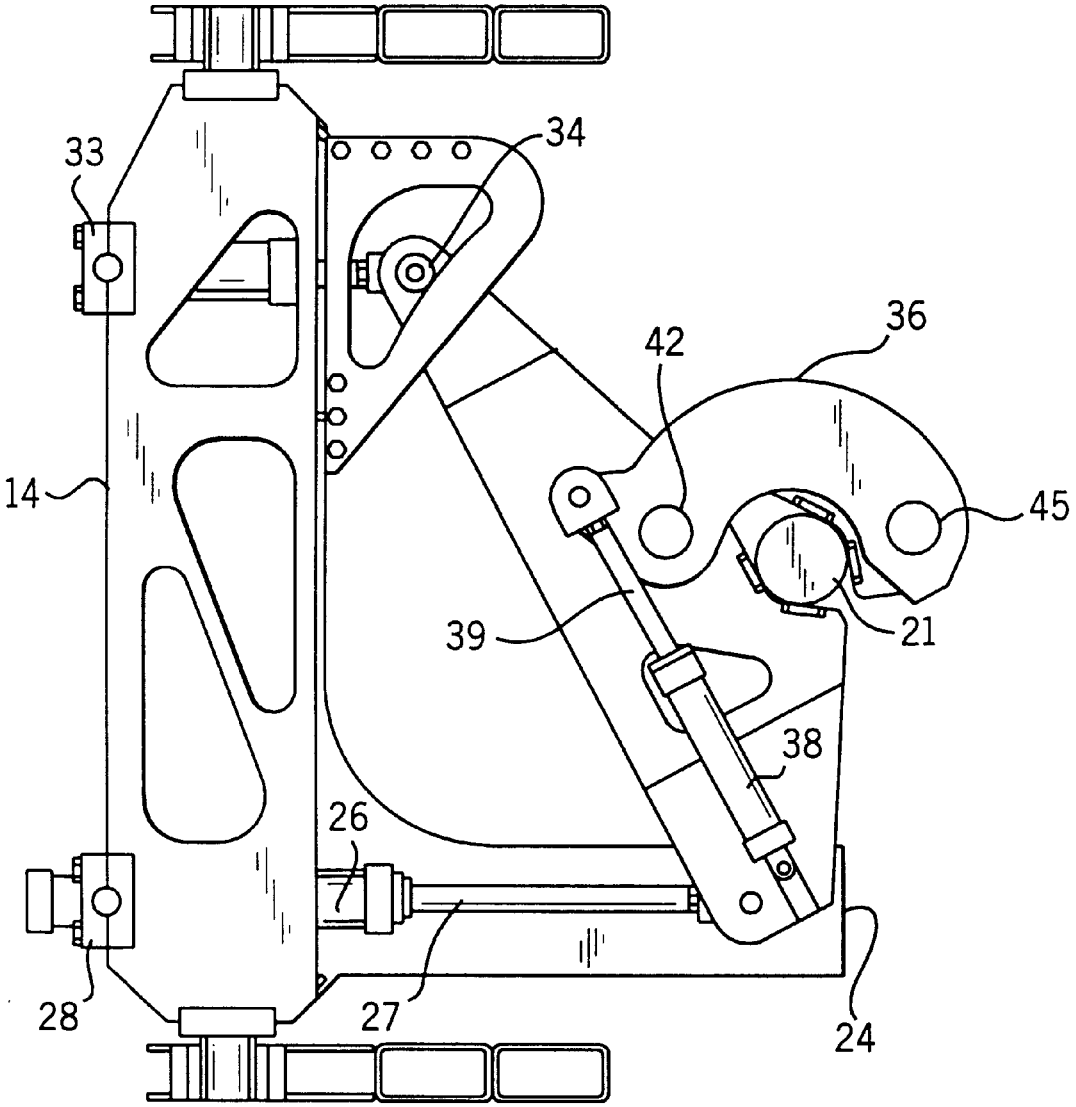

FIG. 11 illustrates the tong assembly 10 in conjunction with a smaller pipe 21 in the same mode as shown in FIG. 8.

Figure 2:
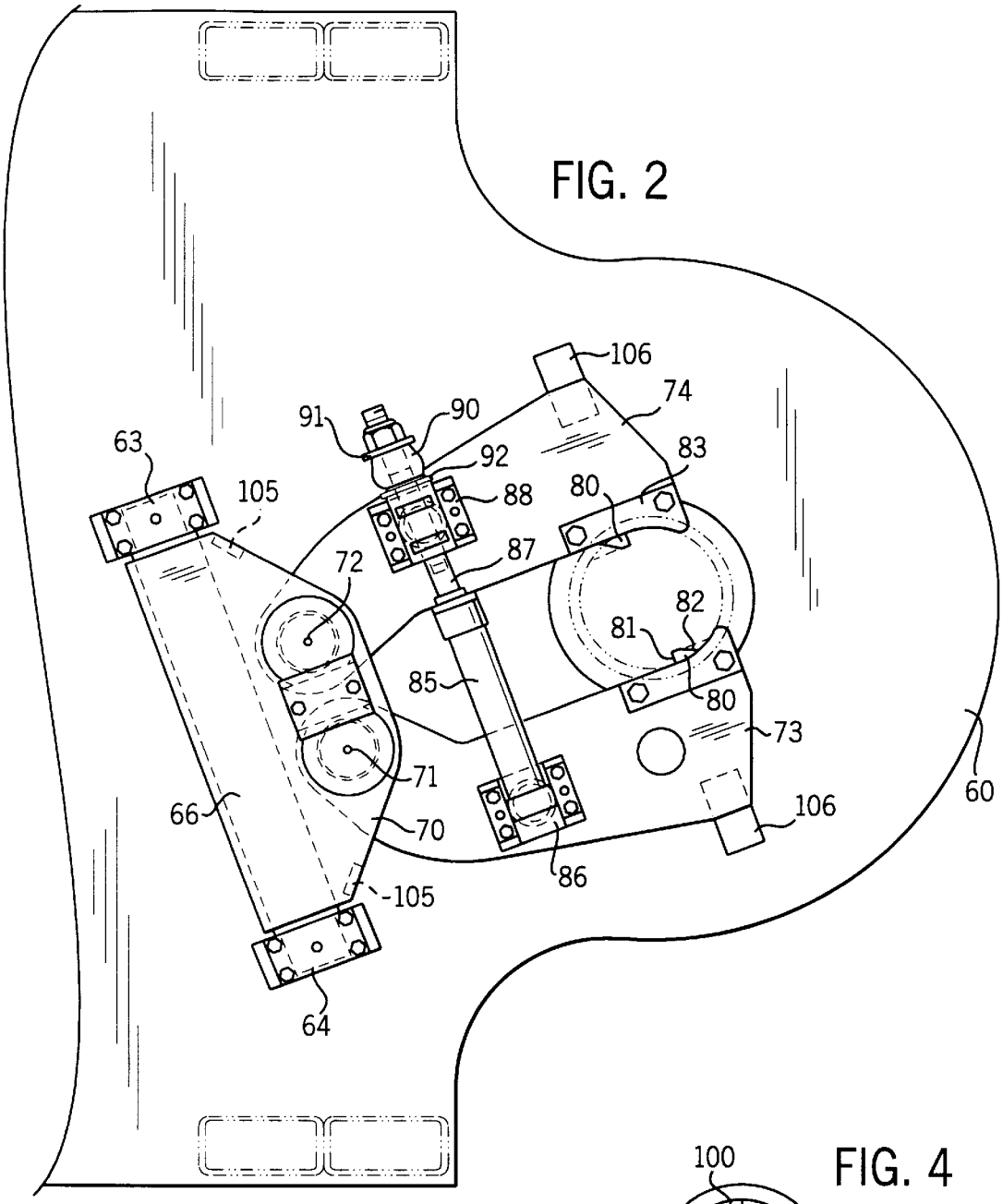
FIG. 2 is a top plan view of the tool wrench with the wrench arms engaged with a drill pipe shown in phantom lines.
Figure 3:
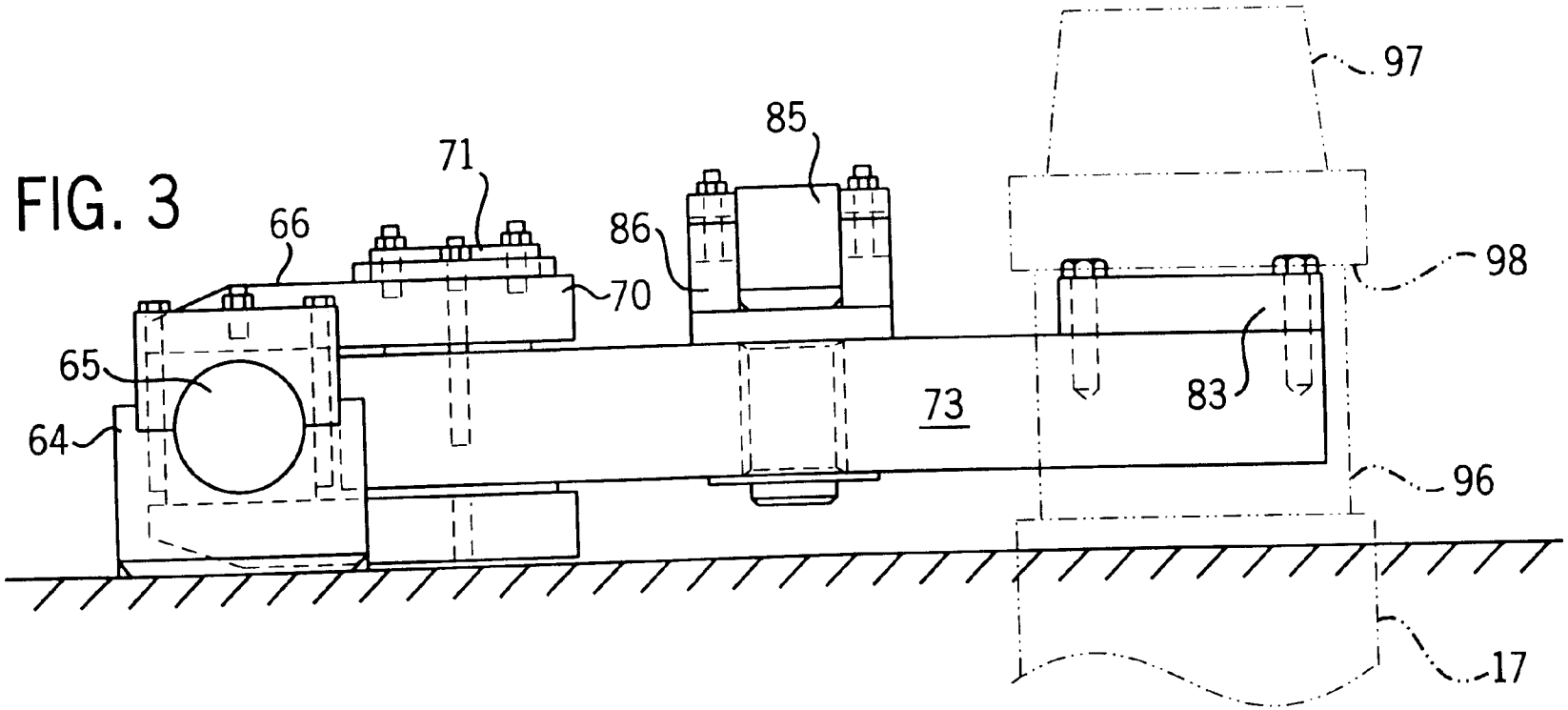
FIG. 3 is a side view in elevation of the tool wrench of FIG. 2, again showing the drill pipe in phantom lines.

The tool wrench 20 is adapted to be mounted on the drill deck 60 of the mast 12 beneath the casing tong assembly 10. The location of the tool wrench 20 in relation to the casing tong assembly 10 and the mast 12 is shown in FIG. 1. FIGS. 2 and 3 show the details of the tool wrench 20. A pair of spaced pillow blocks 63 and 64 assemblies are attached to the deck 60 and mount a pivot rod 65. A support plate 66 is rotatably mounted on the pivot rod 65. The support plate 66 includes a projecting portion 70 that mounts a pair of spaced pivots 71 and 72. One end of a pair of wrench arms 73 and 74 are mounted on the vertical pivots 71 and 72.

Each arm 73 and 74 includes an integral pawl 80 adjacent the free end of the arm. The pawls 80 oppose each other.

Each pawl 80 is generally wedge-shaped with a stop surface 81 and with a curved top surface 82. Replaceable wear pads 83 are mounted adjacent the pawls 80 and define a generally circular opening between the arms 73 and 74.

A hydraulic cylinder 85 is mounted at its base end in a clevis assembly 86 which is attached to one wrench arm 73. The piston rod 87 of the cylinder 85 extends through a rod clevis assembly 88 attached to the other wrench arm 74. A spring mechanism 90 in the form of a compressible polymer bumper is held between a washer 91 mounted on the projecting end of the piston rod 87 and a washer 92 mounted against the rod clevis assembly 88.

Figure 4:
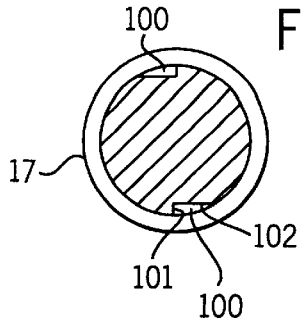
FIG. 4 is a view in cross-section through a drill pipe.

The tool wrench is adapted to be used with a drill pipe 17 having a necked down portion 96 near its threaded top end 97. A shoulder 98 is formed between the necked down portion 96 and the threaded end 97. The perimeter of the necked down portion 96 includes a pair of wedge-shaped slots 100 disposed 180° apart. Each slot 100 has a portion 101 that lies along a diameter of the pipe and a second portion 102 that is transverse to the diameter and extends out to the perimeter of the necked down portion 96, as shown in FIG. 4.

The wrench arms 73 and 74 are retracted away from the drill pipe 17 by extending the hydraulic cylinder 85. When retracted, the wrench arms 73 and 74 will rest against stops 105 in the pivoting support 66. Constant force from the hydraulic cylinder 85 holds the wrench arms 73 and 74 against the stops 105 when the wrench arms 73 and 74 are fully retracted.

To loosen a pipe joint, the drill pipe 17 is hoisted until the necked down portion 96 is aligned to the level of the wrench arms 73 and 74. The wrench arms 73 and 74 are then moved towards each other by retracting the hydraulic cylinder 85 until the pawls 80 of the wrench arms 73 and 74 contact the drill pipe 17. Typically, the pawls 80 will not be aligned with the slots 100 when the pawls first contact the drill pipe 17. As a result, the force from the hydraulic cylinder 85 will compress the spring mechanism 90, and constant force from the hydraulic cylinder 85 will hold the pawls 80 of the wrench arms 73 and 74 against the drill pipe 17. The drill pipe 17 is rotated counterclockwise as viewed in FIG. 2 while the pawls 80 are not engaging the slots 100 in the drill pipe. When the pawls 80 and slots 100 are aligned, the spring mechanism will accelerate the pawls 80 into engagement with the slots 100. A torsional impact will result when the pawls 80 are seated in the slots 100 while a drill pipe is continued to be turned counterclockwise. This may loosen the joint of the threaded end 97 from the pipe 16 above it. If it does not loosen the threaded joint, the casing tong 10 is used to apply the necessary additional torque while the pipe 17 is restrained by the wrench 20.

After the drill pipe joint is loosened, constant force from the hydraulic cylinder 85 holds the pawls 80 in the drill pipe's slots 100. The drill bit, and any additional lengths of drill pipes, are supported by contact between the shoulder 98 on the drill pipe 17 and the wear pads 83 attached to the wrench arms 73 and 74. The wrench arms 73 and 74 are supported by blocks 106 welded to the top of the drill deck 60.

As the drill pipe string is turned clockwise, the pawls 80 will ride out of the slots 100 thereby forcing the wrench arms 73 and 74 to open. Hydraulic oil is allowed to flow from the cylinder 85 to allow this action.

If the drill string is hoisted accidentally when the wrench arms 73 and 74 are contacting the necked down portion 96 of the drill pipe 17, the entire tool wrench assembly will pivot in the pillow blocks 63 and 64. No damage to the tool wrench or mast will result from such accidental hoisting.

The use of the tool wrench of the present invention makes it unnecessary for the drill operator to align flats or slots on the drill pipe to the tool wrench. The pawls 80 will automatically engage the slots 100 upon rotation of the drill pipe 17. The slots 100 allow 180° of counterclockwise pipe rotation and an unlimited ratcheting action with clockwise pipe rotation.

The pivots 71 and 72 for the wrench arms 73 and 74 are located such that the radial forces gripping the drill pipe will increase when torsional impact occurs between the pawls 80 and the rotating drill pipe slots 100. Because of this, the hydraulic cylinder 85 is not exposed to impact loads when the drill pipe joint is loosened. The pivot points 71 and 72 are not symmetrically located relative to the drilling axis. One pivot is located using the smallest diameter drill pipe to be handled, and the other pivot is located using the largest diameter drill pipe to be handled.

Although the preferred embodiment is employed with a triangular and tubular mast 12, it can also be employed with other mast configurations. Furthermore, the invention can be applied generally to loosening members that are joined by a threaded connection.

I claim:

1. A mechanism for applying torque to a member, comprising:

an arm having first and second ends and a grip;

a jaw mounted for movement on the arm and having a grip that can oppose the grip on the arm;

first means for advancing the first end of the arm to engage its grip with the member and for further advancing the first end after engagement;

second means for moving the jaw to engage its grip with the member; and third means for retracting the second end of the arm while the first means further advances the first end of the arm to apply a moment to the member.

2. A method of loosening a threaded joint between a first member and a second member that is prevented from rotating, comprising:

advancing one end of an arm having a grip into contact with one side of the first member;

advancing a jaw having a grip into contact with another side of the first member to clamp the first member between the grips;

applying a force to further advance the one end of the arm while applying a second force to retract an opposite end of the arm to rotate the first member; and releasing the contact of the grips with the first member.

3. A method in accordance with claim 2, wherein the opposite end of the arm is held stationary while the one end of the arm is first advanced.

4. A method of loosening the threaded joint between members of a drill string in which one member is held against rotation, comprising:

pivoting one end of an arm about its second end to advance a grip into contact with one side of the other member;

pivoting a jaw having a grip about a pivot on the arm to contact the grip with another side of the other member; and continuing to pivot the one end of the arm while moving the second end in a direction about the other member that is opposite to the movement of the one end about the other member.

5. A mechanism for loosening a threaded joint between a first member and a second member held against rotation, comprising:

an arm having first and second ends and a grip;

a jaw mounted for movement on the arm and having a grip that can oppose the grip on the arm;

first means for advancing the first end of the arm to engage its grip with the first member and for further advancing the first end of the arm;

second means for moving the jaw to engage its grip with the first member; and third means for retracting the second end of the arm while the first means is further advancing to apply a moment to the first member.

6. A mechanism in accordance with claim 5 wherein the jaw is pivotally mounted on the arm between the ends thereof.

7. A mechanism in accordance with claim 5 wherein the means comprise hydraulic cylinders.

8. A mechanism for loosening a threaded joint between first and second members of a drill string, comprising:

an arm having first and second ends and a grip engageable with the first member;

first and second hydraulic cylinders pivotally connecting the first and second ends of the arm to a common support;

a jaw pivotally mounted to the arm intermediate its ends and having a grip engageable with the first member; and a third hydraulic cylinder connecting the jaw to the arm to pivot the jaw.

* * * * *